US007789738B2

(12) United States Patent
Feng et al.

(10) Patent No.: US 7,789,738 B2
(45) Date of Patent: Sep. 7, 2010

(54) SHEET FOR MOUNTING POLISHING WORKPIECE AND METHOD FOR MAKING THE SAME

(75) Inventors: Chung-Chih Feng, Kaohsiung (TW); I-Peng Yao, Kaohsiung (TW); Chen-Hsiang Chao, Kaohsiung (TW)

(73) Assignee: San Fang Chemical Industry Co., Ltd., Kaoshiung (TW)

( * ) Notice: Subject to any disclaimer, the term of this patent is extended or adjusted under 35 U.S.C. 154(b) by 0 days.

(21) Appl. No.: 11/478,601

(22) Filed: Jul. 3, 2006

(65) Prior Publication Data

US 2008/0003932 A1 Jan. 3, 2008

(51) Int. Cl.
*B24B 41/06* (2006.01)

(52) U.S. Cl. ..... 451/390; 451/397

(58) Field of Classification Search ..... 451/390, 451/397, 402

See application file for complete search history.

(56) References Cited

U.S. PATENT DOCUMENTS 3,345,206 A * 10/1967 Korpman ..... 428/355 AK
3,449,870 A * 6/1969 Jensen ..... 451/36
3,453,783 A * 7/1969 Queen ..... 451/390
3,617,702 A 11/1971 Flournoy
3,650,880 A 3/1972 Tieniber
3,860,399 A * 1/1975 Noble et al. ..... 451/41
4,115,683 A 9/1978 Clark et al.
4,132,037 A * 1/1979 Bonora ..... 451/288
4,239,567 A * 12/1980 Winings ..... 451/390
4,276,341 A 6/1981 Tanaka
4,306,573 A 12/1981 Rudszinat
4,328,410 A 5/1982 Slivinsky et al.
4,466,852 A * 8/1984 Beltz et al. ..... 156/344
4,850,093 A 7/1989 Parente
4,851,061 A 7/1989 Sorkoram
5,058,413 A 10/1991 Muddiman
5,109,638 A * 5/1992 Kime, Jr. ..... 451/539
5,212,910 A 5/1993 Breivogel et al.
5,336,554 A 8/1994 Knight
5,424,813 A 6/1995 Schlueter, Jr. et al.
5,539,182 A 7/1996 Meurer
5,584,146 A 12/1996 Shamouillan et al.
5,632,914 A 5/1997 Hagenow et al.
5,707,385 A 1/1998 Williams
5,781,393 A 7/1998 Tabib-Azar et al.

(Continued)

FOREIGN PATENT DOCUMENTS

CN 2470953 Y 1/2002

(Continued)

*Primary Examiner*—Maurina Rachuba
(74) *Attorney, Agent, or Firm*—Volentine & Whitt, PLLC

(57) ABSTRACT

The present invention relates to a sheet for mounting a polishing workpiece. The sheet comprises a substrate, a surface layer and a slightly rough layer. The substrate has a surface. The surface layer is located on the surface of the substrate, with no hole structure existing in the interior thereof, and has a surface. The slightly rough layer is located on the surface of the surface layer to carry and mount the polishing workpiece, with no hole structure existing in the interior thereof. Accordingly, when the polishing workpiece contacts the slightly rough layer, the air therebetween is easily vented out via the slightly rough layer, without the phenomenon of air wrapping, which increases the adsorption force between the polishing workpiece and the sheet.

7 Claims, 3 Drawing Sheets

U.S. PATENT DOCUMENTS 5,820,448 A * 10/1998 Shamouilian et al. ..... 451/287
5,830,806 A * 11/1998 Hudson et al. ..... 438/690
5,871,393 A * 2/1999 Shiozawa ..... 451/285
5,906,887 A * 5/1999 Withers ..... 428/315.5
5,935,683 A * 8/1999 Iiyama et al. ..... 428/141
5,975,999 A * 11/1999 Nitta ..... 451/354
5,989,470 A 11/1999 Doan et al.
5,993,293 A 11/1999 Cesna et al.
6,074,287 A 6/2000 Miyaji et al.
6,089,965 A 7/2000 Otawa et al.
6,095,900 A * 8/2000 Fruitman et al. ..... 451/28
6,117,776 A * 9/2000 Huber et al. ..... 438/691
6,172,330 B1 1/2001 Yamamoto et al.
6,217,434 B1 4/2001 Roberts et al.
6,344,414 B1 * 2/2002 Davis et al. ..... 438/692
6,346,036 B1 2/2002 Halley
6,367,529 B1 * 4/2002 Yanagisawa ..... 156/350
6,371,833 B1 * 4/2002 Huckels et al. ..... 451/41
6,454,633 B1 9/2002 Reinhardt et al.
6,566,426 B1 5/2003 Kanaida et al.
6,575,821 B2 6/2003 Jost
6,657,158 B1 12/2003 Skelly et al.
6,726,541 B2 4/2004 Nakamura et al.
6,739,040 B1 5/2004 Nakamura et al.
6,824,456 B2 * 11/2004 Ebner et al. ..... 451/287
6,855,043 B1 * 2/2005 Tang et al. ..... 451/398
7,241,408 B2 7/2007 Shih et al.
7,295,425 B2 11/2007 Suenaga et al.
7,316,605 B1 * 1/2008 Feng et al. ..... 451/533
7,384,061 B2 6/2008 Haba et al.
2003/0068967 A1 4/2003 Nakamura et al.
2006/0116059 A1 6/2006 Chen et al.
2008/0003927 A1 * 1/2008 Feng et al. ..... 451/56
2008/0003933 A1 * 1/2008 Feng et al. ..... 451/490
2008/0003934 A1 * 1/2008 Feng et al. ..... 451/526

FOREIGN PATENT DOCUMENTS

DE 10128745 A1 1/2003
EP 0 002 465 A1 6/1979
FR 2679526 A1 1/1993
JP 1199479 A 8/1989
JP 07235050 A * 9/1995
JP 2001352861 12/2001
JP 200474301 A 3/2004
JP 2004306195 A 11/2004
JP 2005-116948 4/2005
JP 2006-167835 6/2006
KR 20030020784 3/2003
KR 20040048464 6/2004
TW 508284 5/1990
TW 200616084 11/2004

* cited by examiner

SHEET FOR MOUNTING POLISHING WORKPIECE AND METHOD FOR MAKING THE SAME

BACKGROUND OF THE INVENTION

1. Field of the Invention

The present invention relates to a sheet for mounting a workpiece to be polished (herein referred to as a "polishing workpiece") and the method for making the same, and more particularly, to a sheet for mounting a workpiece to be polished and the method for making the same which are used in the chemical mechanical polishing process.

2. Description of the Related Art

Polishing generally refers to a wear control for a preliminary coarse surface in the process of chemical mechanical polishing (CMP), which makes the slurry containing fine particles evenly dispersed on the upper surface of a polishing pad, and at the same time places a polishing workpiece (i.e., a workpiece to be polished) against the polishing pad and then rubs the workpiece repeatedly with a regular motion. The polishing workpiece may be objects such as a semiconductor, a storage medium substrate, an integrated circuit, an LCD flat-panel glass, an optical glass and a photoelectric panel. During the polishing, a sheet must be used for carrying and mounting the polishing workpiece, and the quality of the sheet directly influences the polishing effect of the polishing workpiece.

Referring to FIG. 1, a schematic view of a polishing device with a conventional sheet disclosed in U.S. Pat. No. 5,871,393 is shown. The polishing device 1 includes a lower base plate 11, a sheet 12, a polishing workpiece 13, an upper base plate 14, a polishing pad 15 and slurry 16. The sheet 12 is adhered to the lower base plate 11 through an adhesive layer 17 and is used for carrying and mounting the polishing workpiece 13. The polishing pad 15 is mounted on the upper base plate 14.

The operation mode of the polishing device 1 is as follows. First, the polishing workpiece 13 is mounted on the sheet 12, and then both the upper and lower base plates 14 and 11 are rotated and the upper base plate 14 is simultaneously moved downwards, such that the polishing pad 15 contacts the surface of the polishing workpiece 13. A polishing operation for the polishing workpiece 13 may be performed by continuously supplementing the slurry 16 and using the polishing pad 15.

Referring to FIG. 2, a local schematic view of the sheet of FIG. 1 is shown. The sheet 12 is of a single-layer structure, the material of which is generally PU (polyurethane), a kind of foaming material. The sheet 12 is formed by a wet process, and thus a plurality of continuous foaming holes 121 exists in the interior of the sheet 12. The disadvantage of the sheet 12 is that the slurry 16 tends to be inhaled through the foaming holes 121 during the polishing process, which causes changes in the hardness and physical property of the sheet 12, such that the polishing condition needs to be readjusted. Furthermore, the lifetime of the sheet 12 is reduced. In addition, the sheet 12 is formed by the wet process which results in an excessively low planarity, and it is very difficult to achieve a generally uniform thickness above 0.5 mm. Finally, the foaming holes 121 within the sheet 12 cause the phenomenon of air wrapping when the sheet 12 adsorbs the polishing workpiece 13, thus resulting in a poor adhesion and a possible crack during the polishing process as well as an uneven polished surface after the polishing of the polishing workpiece 13.

Consequently, there is an existing need for a sheet for mounting a polishing workpiece and the method for making the same to solve the above-mentioned problems.

SUMMARY OF THE INVENTION

The objective of the present invention is to provide a sheet for mounting a polishing workpiece. The sheet of the present invention comprises a substrate, a surface layer and a slightly rough layer. The substrate has a surface. The surface layer is located on the surface of the substrate, with no hole structure existing in the interior thereof, and has a surface. The slightly rough layer is located on the surface of the surface layer to carry and mount the polishing workpiece, with no hole structure existing in the interior thereof. Accordingly, when the polishing workpiece contacts the slightly rough layer, the air therebetween is easily vented out via the slightly rough layer, without the phenomenon of air wrapping, which increases the adsorption force between the polishing workpiece and the sheet, thereby improving the polishing effect of the polishing workpiece. Additionally, since no hole structure exists in the interior of both the surface layer and the slightly rough layer, the slurry will not be inhaled during the polishing, thus prolonging the lifetime of the sheet.

Another objective of the present invention is to provide a method for making the sheet for mounting a polishing workpiece, which comprises the following steps:

(a) forming a surface layer on a release paper, the surface layer having no hole structure in the interior thereof;
(b) forming a substrate on the surface layer;
(c) drying the surface layer and the substrate;
(d) removing the release paper; and
(e) printing a slightly rough layer on the surface layer, the slightly rough layer having no hole structure in the interior thereof.

DETAILED DESCRIPTION OF THE INVENTION

Figure 1:
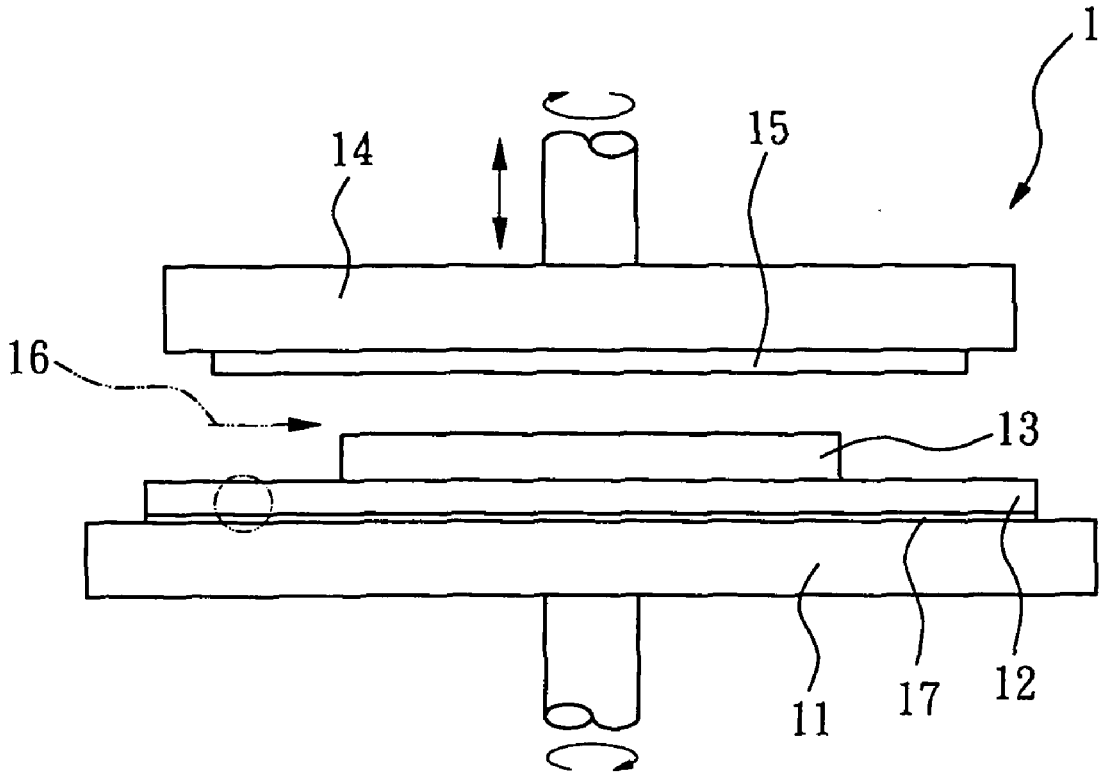
FIG.1 (Prior Art)
FIG. 1 shows a schematic view of the polishing device with a conventional sheet disclosed in U.S. Pat. No. 5,871,393.
Figure 2:
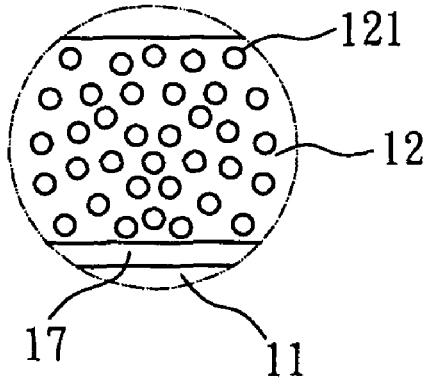
FIG.2 (Prior Art)
FIG. 2 shows a local schematic view of the sheet of FIG. 1.
Figure 3:
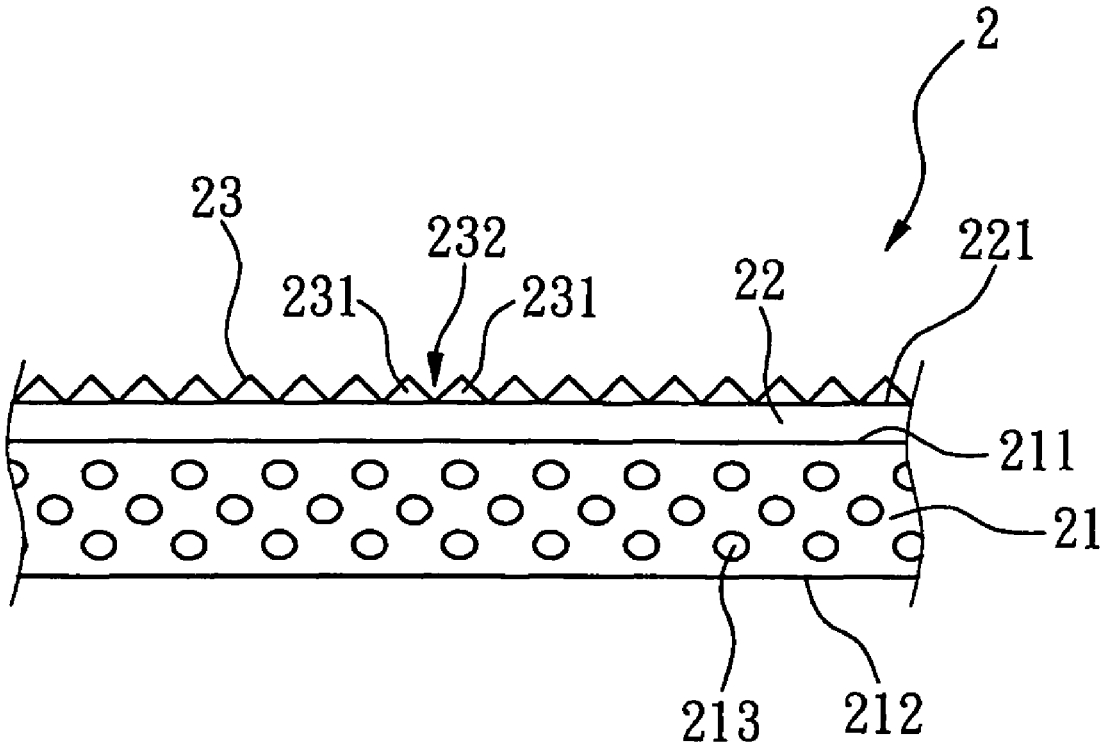
FIG. 3 shows a local schematic view of the sheet for mounting the polishing workpiece according to the present invention.

Referring to FIG. 3, a local schematic view of the sheet for mounting the polishing workpiece according to the present invention is shown. The sheet 2 of the present invention is of a three-layered structure, which comprises a substrate 21, a surface layer 22 and a slightly rough layer 23. The substrate 21 has a first surface 211 and a second surface 212, wherein the second surface 212 is used for being adhered on the lower base plate (not shown) of a polishing device. In this embodiment, the material of the substrate 21 is high solid PU, with a plurality of continuous or discontinuous type holes 213 existing in the interior of the substrate 21, and the thickness of the substrate 21 can be larger than 0.5 mm. However, it is to be understood that the material of the substrate 21 may also be acrylic resin or another kind of resin.

The surface layer 22 is located on the first surface 211 of the substrate 21, and has a surface 221. The surface layer has no hole structure in the interior thereof. The material of the surface layer 22 is a polymeric elastomer without foam (for example PU, acrylic resin or another kind of resin). The surface layer 22 has a uniform thickness which is less than that of the substrate 21. The materials of the surface layer 22 and substrate 21 may be the same or different.

The slightly rough layer 23 is located on the surface 221 of the surface layer 22, and is used for carrying and mounting a polishing workpiece (not shown). No hole structure exists in the interior of the slightly rough layer 23, and the material of the slightly rough layer 23 is a polymeric elastomer without foam (for example PU, acrylic resin or another kind of resin). The materials of the slightly rough layer 23 and surface layer 22 may be the same or different. As shown in FIG. 3, the slightly rough layer 23 includes a plurality of periodic protrusions 231 which extend upwardly from the surface 221 so as to form a rough surface. As shown in the figure, the periodic protrusions 231 are regularly repeated, and each protrusion has a height and the heights of the protrusions 231 are equal. The protrusions 231 define periodically spaced vent spaces 232 therebetween. That is, each vent space 232 is formed between two protrusions 231 of the slightly rough layer 23, and when the polishing workpiece contacts the rough surface of the slightly rough layer 23, the air therebetween may be easily vented out via the vent space 232, without the phenomenon of air wrapping, which increases the adsorption force between the polishing workpiece and the sheet 2, thereby improving the polishing effect of the polishing workpiece. Additionally, since no hole structure exists in the interior of both the surface layer 22 and the slightly rough layer 23, the slurry will not be inhaled during the polishing, thus prolonging the lifetime of the sheet 2.

The present invention further relates to a method for making the sheet for mounting a polishing workpiece, which comprises the following steps.

Figure 4:
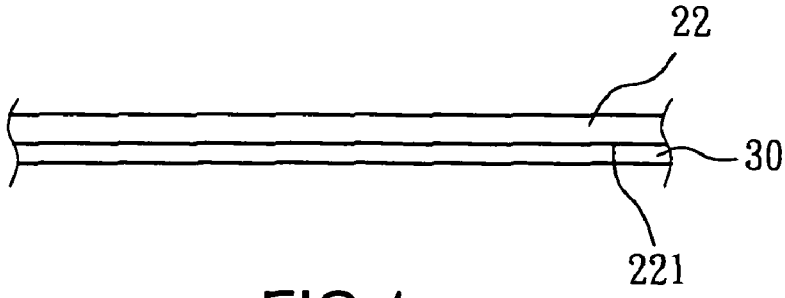
FIGS. 4 to 6 show schematic views of each process step of the method for making the sheet for mounting the polishing workpiece according to the present invention.

At first, referring to FIG. 4, a surface layer 22 is formed on a release paper 30. The surface layer 22 has no hole structure existing in the interior thereof. The surface layer 22 has a surface 221. The material of the surface layer 22 is a polymeric elastomer without foam (for example PU, acrylic resin or another kind of resin), and the surface layer 22 has a uniform thickness. Preferably, the surface layer 22 is formed on the release paper 30 in a manner of coating.

Figure 5:
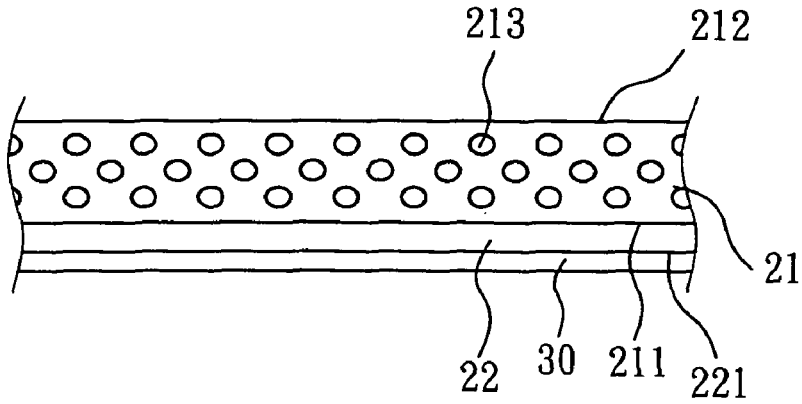

Then, referring to FIG. 5, a substrate 21 is formed on the surface layer 22, the substrate 21 has a first surface 211 and a second surface 212. In this embodiment, the material of the substrate 21 is high solid PU, with a plurality of continuous or discontinuous type holes 213 existing in the interior of the substrate 21, and the thickness of the substrate 21 is larger than 0.5 mm. However, it is to be understood that the material of the substrate 21 may also be acrylic resin or another kind of resin. The materials of the surface layer 22 and the substrate 21 may be the same or different. Preferably, the substrate 21 is formed on the surface layer 22 in a manner of coating. Therefore, compared with the conventional wet process, the substrate 21 of the invention can remain a uniform thickness when the thickness thereof is larger than 0.5 mm.

Then, the substrate 21 and surface layer 22 are dried for one day. After that, the release paper 30 is removed.

Figure 6:
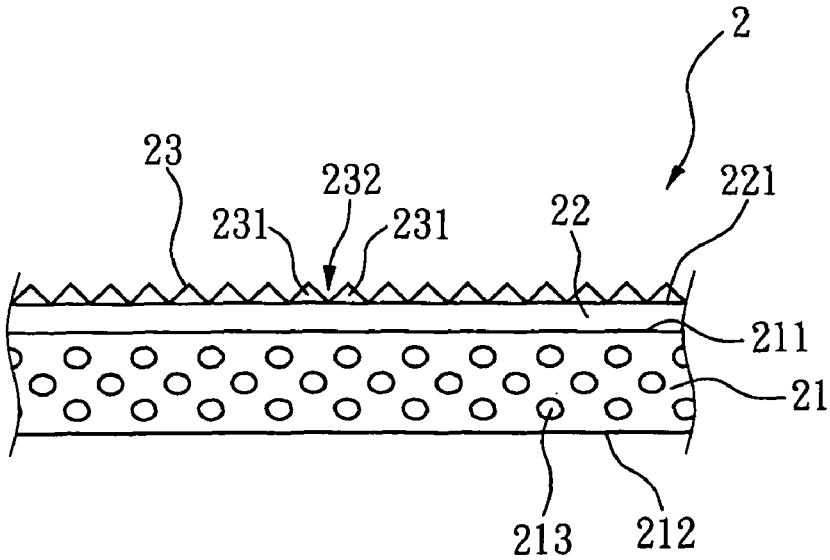

At last, referring to FIG. 6, after turning the substrate 21 and the surface layer 22 upside-down for 180 degrees, a slightly rough layer 23 is printed on the surface 221 of the surface layer 22 to form the sheet 2 (the same as FIG. 3). No hole structure exists in the interior of the slightly rough layer 23, and the material of the slightly rough layer 23 is a polymeric elastomer without foam (for example PU, acrylic resin or another kind of resin). The materials of the slightly rough layer 23 and surface layer 22 may be the same or different. In this embodiment, the printing step is screen printing.

Preferably, a water repellent treatment may also be performed for the slightly rough layer 23 to prolong the lifetime of the sheet 2.

While several embodiments of the present invention have been illustrated and described, various modifications and improvements can be made by those skilled in the art. The embodiments of the present invention are therefore described in an illustrative but not restrictive sense. It is intended that the present invention may not be limited to the particular forms as illustrated, and that all modifications which maintain the spirit and scope of the present invention are within the scope as defined in the appended claims.

What is claimed is:

1. A sheet for mounting a workpiece to be polished, comprising:

a substrate, having a surface;

a surface layer, located on the surface of the substrate, having no hole structure in the interior thereof, and having a surface; and a rough layer, located on the surface of the surface layer, and for carrying and mounting the workpiece to be polished, and having no hole structure in the interior thereof, the rough layer including a plurality of periodic protrusions to define a rough surface of the rough layer, wherein the periodic protrusions are regularly repeated, wherein each protrusion has a height and the heights of the protrusions are equal, and wherein the periodic protrusions define periodic and regularly spaced vent spaces therebetween, wherein air is vented out via the vent spaces when the workpiece to be polished contacts the rough surface of the rough layer.

2. The sheet as claimed in claim 1, wherein a plurality of holes exists in the interior of the substrate.

3. The sheet as claimed in claim 2, wherein the holes of the substrate are of a continuous type.

4. The sheet as claimed in claim 2, wherein the holes of the substrate are of a discontinuous type.

5. The sheet as claimed in claim 1, wherein the material of the substrate is resin, and the thickness of the substrate is larger than 0.5 mm.

6. The sheet as claimed in claim 1, wherein the material of the surface layer is a polymeric elastomer without foam, and the thickness of the surface layer is less than that of the substrate.

7. The sheet as claimed in claim 1, wherein the material of the rough layer is a polymeric elastomer.

* * * * *